US006930577B2

(12) United States Patent
Subramanian et al.

(10) Patent No.: US 6,930,577 B2
(45) Date of Patent: Aug. 16, 2005

(54) CIRCUIT BREAKER LUG COVER AND GASKET

(75) Inventors: Ananthram Subramanian, Secunderabad (IN); Ronald Ciarcia, Bristol, CT (US); Narender Macha, Hyderbad (IN); Luis Brignoni, Toa Baja, PR (US); Paul Douglas Lafferty, Farmington, CT (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 10/605,206

(22) Filed: Sep. 15, 2003

(65) Prior Publication Data

US 2005/0057333 A1 Mar. 17, 2005

(51) Int. Cl.[7] ..... H01H 13/04
(52) U.S. Cl. ..... 335/202; 200/304
(58) Field of Search ..... 335/6, 8–10, 201–202; 200/293–308; 439/810–814; 218/154–157

(56) References Cited

U.S. PATENT DOCUMENTS 3,824,555 A 7/1974 Klein et al.
4,620,076 A * 10/1986 Mrenna et al. ..... 200/304
4,809,132 A 2/1989 Palmieri et al.
4,965,418 A * 10/1990 Arnold et al. ..... 218/155
5,150,091 A 9/1992 Hart et al.
5,206,614 A * 4/1993 Carothers ..... 335/16
5,488,337 A * 1/1996 Hubbard et al. ..... 335/202
5,753,877 A * 5/1998 Hartzel et al. ..... 218/157
5,811,749 A * 9/1998 Bausch et al. ..... 218/157
6,114,641 A 9/2000 Castonguay et al.
6,172,586 B1 * 1/2001 Ferree et al. ..... 335/502
6,175,288 B1 1/2001 Castonguay et al.
6,211,759 B1 * 4/2001 Little et al. ..... 335/202
6,218,919 B1 4/2001 Ciarcia et al.
6,307,456 B1 10/2001 Caggiano et al.
6,396,369 B1 5/2002 Schlitz et al.
6,624,375 B2 * 9/2003 Leone et al. ..... 218/155
6,733,347 B2 * 5/2004 Palet Mercader et al. .. 439/810

* cited by examiner

*Primary Examiner*—Lincoln Donovan
(74) *Attorney, Agent, or Firm*—Cantor Colburn LLP

(57) ABSTRACT

A molded insulator cover for a circuit breaker molded case includes a terminal connector attachable to the strap terminal. The terminal connector is disposed in the circuit breaker molded case and an insulator discrete from the molded case is disposed around the terminal connector. The insulator is trapped into the circuit breaker molded case by attachment of the terminal connector to the strap terminal. The insulator is configured to be used with a plurality of different field installable terminal connectors.

26 Claims, 4 Drawing Sheets

CIRCUIT BREAKER LUG COVER AND GASKET

BACKGROUND OF THE INVENTION

The present invention relates generally to molded case circuit breakers and particularly to lug terminals or other terminal connectors used thereon. Still more particularly, this invention relates to insulators covering the lugs or terminal connectors, trapped to the circuit breaker by attachment of the lug or terminal to the circuit breaker terminal.

Circuit breakers are commonly mounted within an electrical enclosure or draw out unit to provide overcurrent protection to a circuit. A line side of the circuit breaker is connected to an electrical power line supplying electricity and a load side of the circuit breaker is connected to the circuit to be protected. In all circuit breakers, the separation of the breaker contacts due to a short circuit causes an electrical arc to form between the separating contacts. The arc causes the formation of relatively high-pressure gases as well as ionization of air molecules within the circuit breaker including carbon deposits. These high-pressure gases can cause damage to the breaker casing and the carbon deposits on the lugs and lug screws can lead to dielectric breakdown. The gases, therefore, must be vented from the circuit breaker enclosure. In addition, a phase-to-phase fault can occur if the arc gases from different phases are allowed to mix, and a phase-to-ground fault can occur if the gases contact the grounded enclosure. To avoid a phase-to-phase or phase-to-ground fault, gases vented from different phases must be kept separate from each other and away from the grounded enclosure until the ionization has dissipated. These high temperature gases must exit the circuit breaker enclosure in order to prevent the circuit breaker enclosure from becoming over-stressed. Ventilated circuit breakers provide openings within the circuit breaker enclosure to allow the ionized gases to exit the circuit breaker in a controlled manner.

During installation of a circuit breaker, terminal straps extending from either a line side or a load side of a circuit breaker must be connected to its source or load (such as to bus lines or cable lines). Connection may be accomplished by inserting a screw, or other rod-shaped connector, through a hole in the terminal strap and through an opening in a connector for the source or load. A nut, or equivalent receiving or tightening device, may then be attached to the screw for securing the connection between the terminal strap and the source or load.

It is known to provide a wiring connector or lug on the load terminal of a molded case circuit breaker. These wiring lugs have at least one wire-receiving opening in an end face. The opening is individually intersected by a threaded opening which intersects the wire-receiving opening at a right angle. A set screw in the threaded opening projects into the wire-receiving opening to clamp a wire in a respective opening. This lug permits power through the circuit breaker to be distributed to a load device downstream or received from a source upstream of the circuit breaker.

It is further known to provide a molded insulating terminal cover which attaches to and becomes an extension of the circuit breaker molded case to provide an insulating covering for the lug terminals. Molded insulating lug covers require the circuit breaker molded case to be suitably configured with cooperative attachment features to receive the molded such attachment features molded into the members of the molded case and cannot readily receive a retrofit lug terminal or other terminal connector, such as for a bus bar connection.

A differently configured molded insulating terminal cover is utilized in a bus bar terminal connection which attaches to and becomes an extension of the circuit breaker molded case to provide an insulating covering for bus bar terminal connections. These molded insulating lug covers also require the circuit breaker molded case to be suitably configured with cooperative attachment features to receive the molded such attachment features molded into the members of the molded case and cannot readily receive a retrofit lug terminal or other terminal connector.

It would be economically advantageous, to provide bus covers and lug covers for molded case industrial-rated circuit breakers which require no additional fastening means for holding the lug and bus covers to the circuit breaker enclosure while providing improved isolation of the lugs or terminals and corresponding terminal screws. Accordingly, one purpose of the invention is to describe both lug and bus covers for industrial-rated circuit breakers which are economically feasible for both factory as well as field-installation.

BRIEF DESCRIPTION OF INVENTION

The above discussed and other drawbacks and deficiencies of the prior art are overcome or alleviated by a circuit breaker molded case including a strap terminal extending therefrom and a terminal connector attached to the strap terminal disposed in the circuit breaker molded case. An insulator cover discrete from the molded case is disposed around the terminal connector and is trapped into the circuit breaker molded case by attachment thereof to the strap terminal. The insulator cover is configured to be used with a plurality of different field installable terminal connectors while providing electrical isolation of the terminal connector.

In an exemplary embodiment of the present invention, the insulator cover includes a substantially C-shaped member having a bottom wall disposed under the terminal connector and defined by a back wall for disposal against the molded case, and sidewalls connected with the bottom wall and back wall extending along opposite sides of the terminal connector. A snap-fit feature extends from each side wall and the bottom wall and each are configured for snap-fit engagement with the molded case having a complementary snap-fit feature for snap-fit engagement therebetween. The insulator cover preferably includes a discrete a gasket disposed over each respective strap terminal and intermediate the molded case and insulator cover.

BRIEF DESCRIPTION OF THE DRAWINGS

Referring now to the drawings wherein like elements are numbered alike in the several Figures.

DETAILED DESCRIPTION OF THE INVENTION

Figure 1:
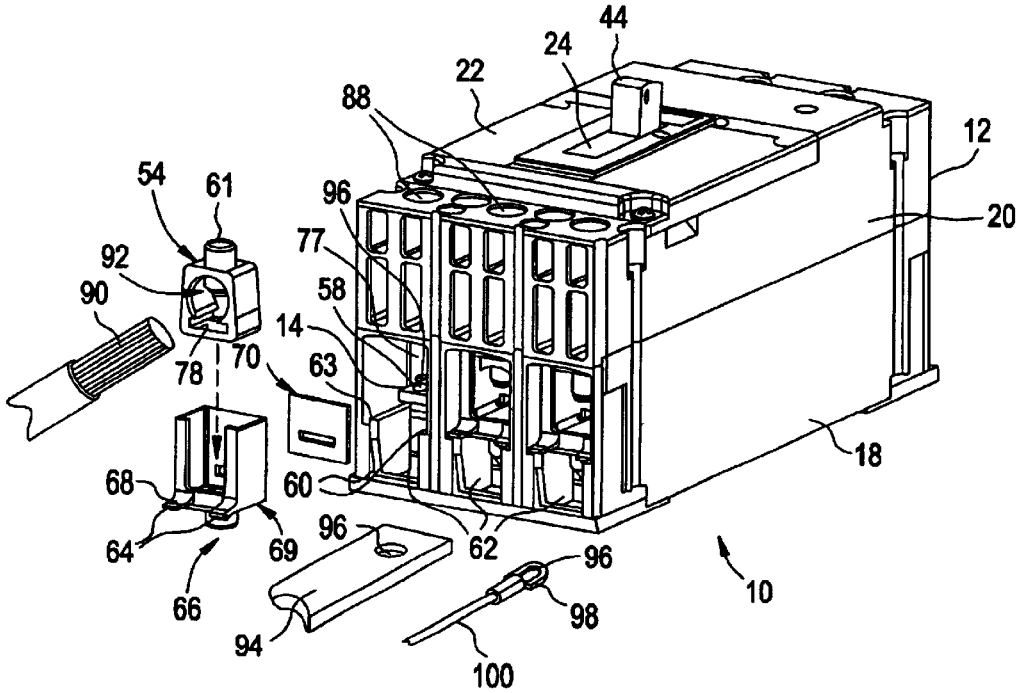
FIG. 1 is a top perspective view of a three phase molded case circuit breaker and three different connection terminals for connection therewith illustrating two lug covers and corresponding gaskets installed and an exemplary embodiment of a lug, a lug cover, and gasket removed therefrom.

Referring to FIG. 1, a top perspective view of a molded case circuit breaker 10 is generally shown. Molded case circuit breaker 10 is generally interconnected within a protected circuit between multiple phases of a power source (not shown) at line end 14 and a load to be protected (not shown) at load end 12. Molded case circuit breaker 10 includes a base 18, a mid cover 20 and a top cover 22 having a toggle handle 44 (operating handle) extending through an opening 24. Toggle handle 44 is interconnected with a circuit breaker operating mechanism (not shown) and allows for external operation of individual cassettes disposed therebeneath. The circuit breaker in FIG. 1 shows a typical three phase configuration, however, the present invention is not limited to this configuration but may be applied to other configurations, such as the typical one, two or four phase circuit breakers.

Figure 2:
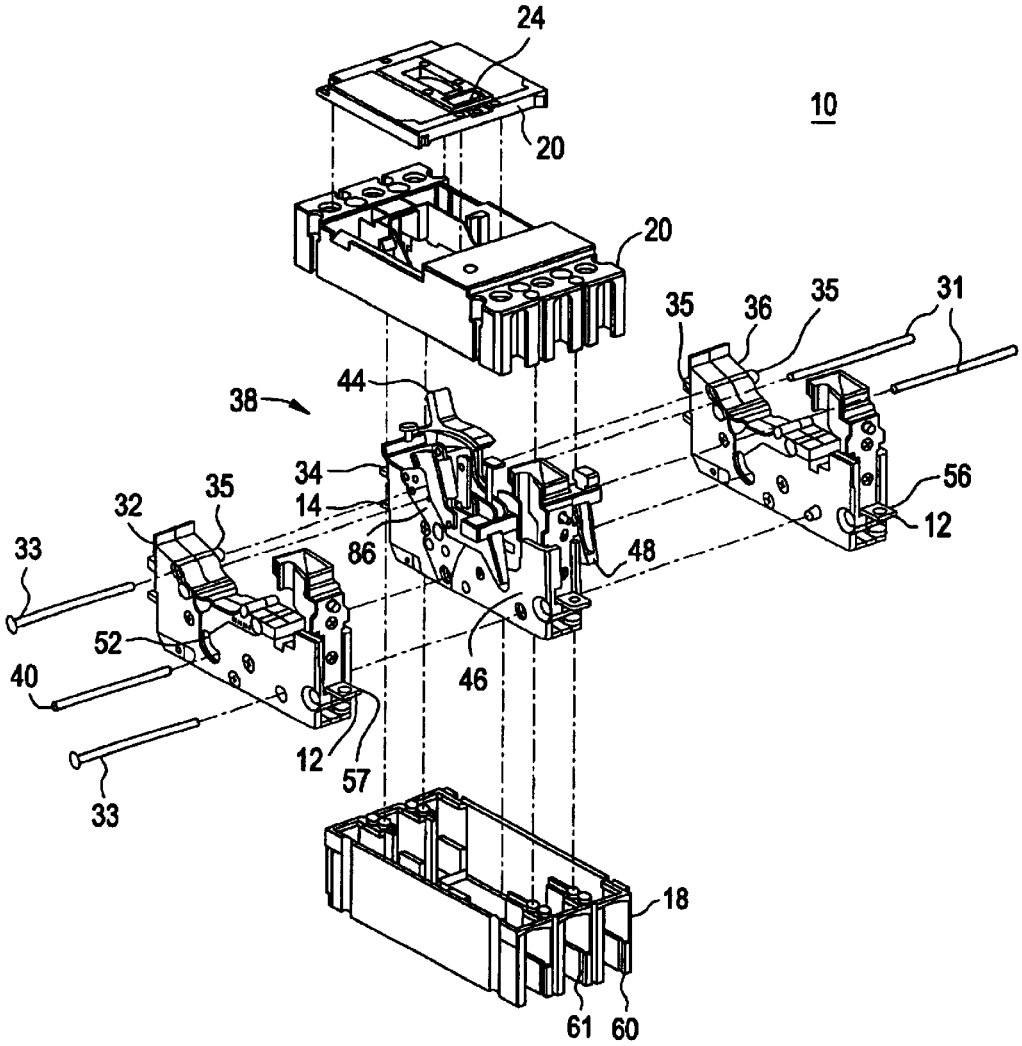
FIG. 2 is an exploded perspective view of a molded case circuit breaker.

Referring now to FIG. 2, an exploded view of molded case circuit breaker 10 is provided. A series of circuit breaker cassettes 32, 34, 36 are generally well known and may be, for example, of the rotary type. Examples of rotary contact structures that may be operated by operating mechanism 38 are described in more detail in U.S. Pat. Nos. 6,114,641 and 6,396,369, both entitled "Rotary Contact Assembly For High-Ampere Rated Circuit Breakers", and U.S. Pat. No. 6,175,288, entitled "Supplemental Trip Unit For Rotary Circuit Interrupters".

Circuit breaker cassettes 32, 34, 36 are seated approximately upstanding within base 18, and the cassette 34 includes operating mechanism 38 positioned thereon. The individual phases of current are divided into three phases, wherein each phase passes through one of the circuit breaker cassettes 32, 34, 36. Each of cassettes 32, 34, 36 includes one or more contact pairs therein for passage of current when the contacts are closed and for preventing passage of current when the contact pairs are opened. It is contemplated that the number of phases, or specific type of cassette utilized, can vary according to factors including, but not limited to, the type of load circuit being protected and the type of line input being provided to the circuit breaker 10.

Still referring to FIG. 2, each cassette 32, 34, 36 is commonly operated by a first cross bar (cross pin) 40 that interfaces with the internal mechanisms of cassettes 32, 34, 36 such that when one of cassettes 32, 34, 36 are opened or closed, the other cassettes 32, 34, 36 will operate cooperatively. It will be recognized by one skilled in the pertinent art that only one cross bar may be used to interface with the internal mechanisms of cassettes 32, 34, 36 such that when one of cassettes 32, 34, 36 are opened or closed, the other cassettes 32, 34, 36 will operate cooperatively. Positioning rods 33 and protrusions 35 in cassettes 32, 36 are also employed to position the cassettes 32, 34, 36 adjacent to each other. Positioning rods 31 are also used to position mechanism 38 to locate cross bar 40 to align with rotary contact assembly 56 within cassettes 32, 34, 36. Operating mechanism 38 is positioned and configured atop cassette 34, which is generally disposed intermediate to cassettes 32 and 36. Operating mechanism 38 operates substantially as described herein and as described in U.S. Pat. No. 6,218,919, entitled "Circuit Breaker Latch Mechanism with Decreased Trip Time". It should also be noted that employment of other operating mechanisms is contemplated, as well. The cassettes 32, 34, 36 are typically formed of high strength plastic material and each include opposing sidewalls.

To allow connection with the external electrical circuits to be protected, load lugs 54 are connected with a corresponding load strap 57 extending from the circuit breaker 10 with reference to FIGS. 1 and 2. A similar pair of line lug compartments are provided on the opposite side of the circuit breaker case 10 to contain the line lugs 54 identical to load lugs 54. Line lugs 54 are connected with a corresponding line strap 58 extending from the circuit breaker 10 with reference to FIG. 1. External electrical connection is made with the lugs 54 by means of terminal screws 61 attached to the top surface thereof.

Figure 3:
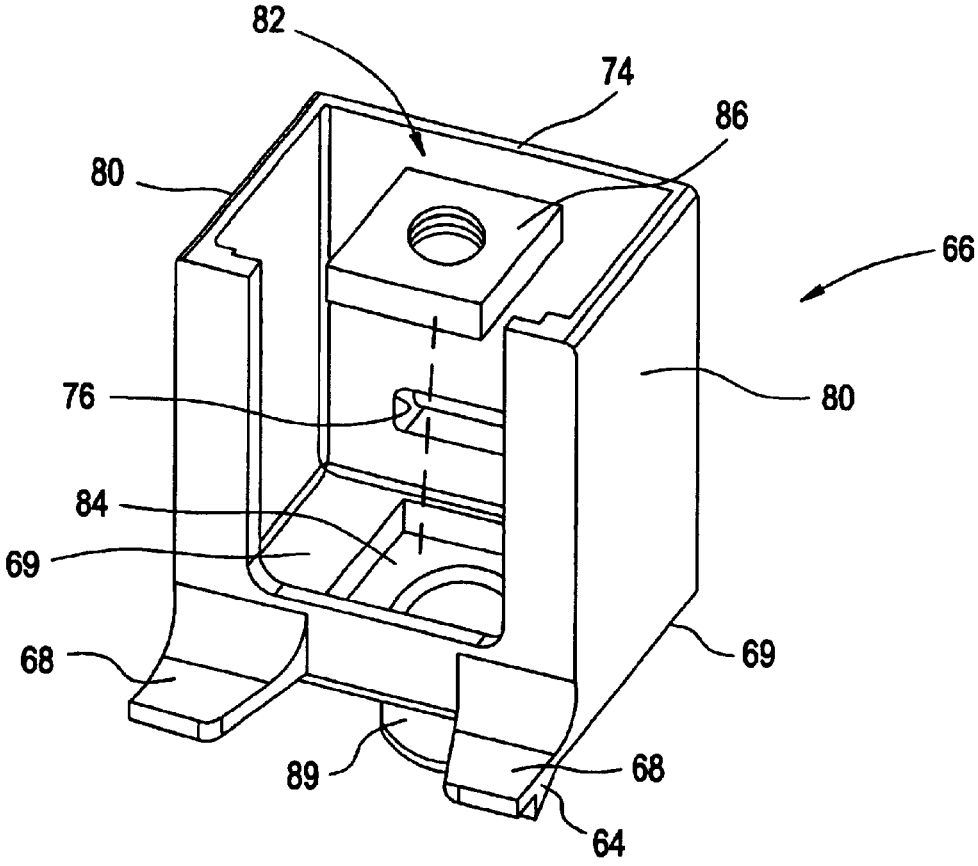
FIG. 3 is an enlarged perspective view of the lug cover of FIG. 1.
Figure 5:
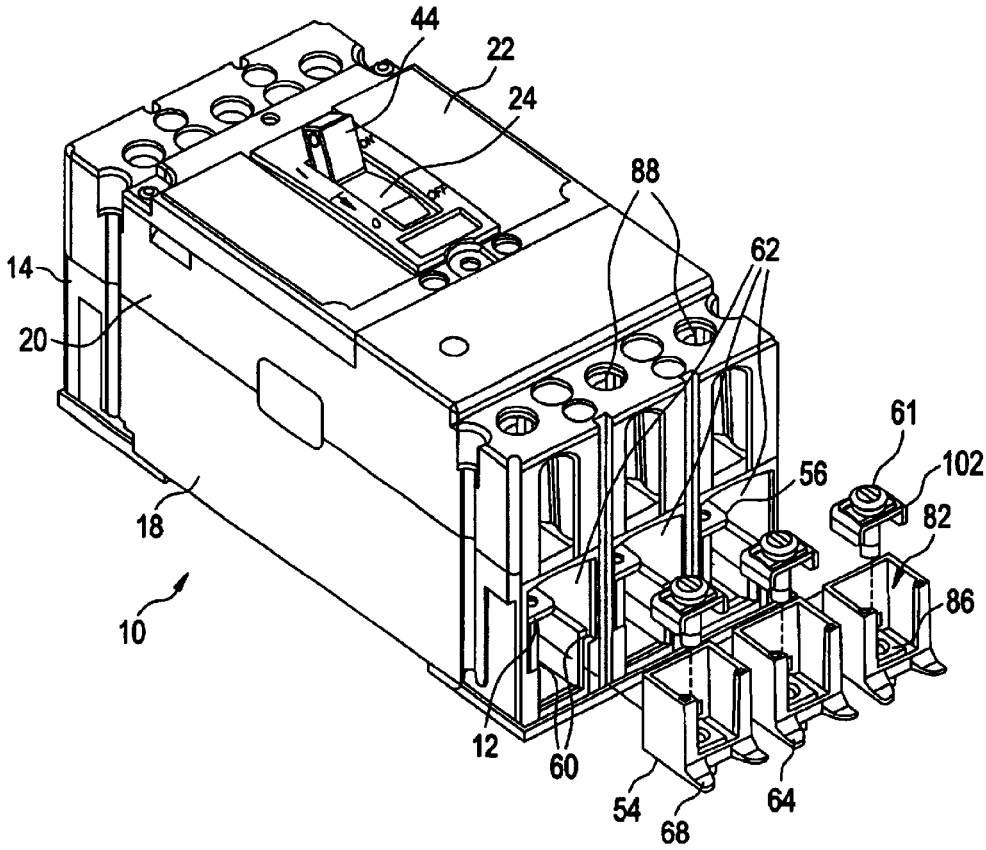
FIG. 5 is a top perspective view of the three phase molded case circuit breaker of FIG. 1 illustrating use of saddle clamps for use with the lug covers of FIG. 1.

To facilitate field-installation of the lugs 54, a pair of rails 60 are formed integrally with the circuit breaker case 10 on the interior opposing surfaces of each load lug compartment 62. As shown in FIGS. 1, 3, and 5 a corresponding pair of snap-fit features 64 are formed on opposite sides of a lug cover 66 configured to be in snap fit engagement with a corresponding rail 60 and a groove 63 defined by each rail 60. Lug cover 66 in turn is received in a corresponding lug compartment 62 and retained therein using snap-fit features 64 in a corresponding rail 60. Each snap-fit feature 64 extends from a corresponding flange 68 that is configured to rest on a respective rail 60. Snap-fit features 64 and flanges 68 are integrally formed on the opposing sides of a bottom wall 69 defining cover 66. By capturing the snap-fit features 64 within the grooves 61 and the flange 68 resting on the rail, the lugs 54 are restrained from moving in the vertical and horizontal directions as viewed in FIG. 1.

Figure 4:
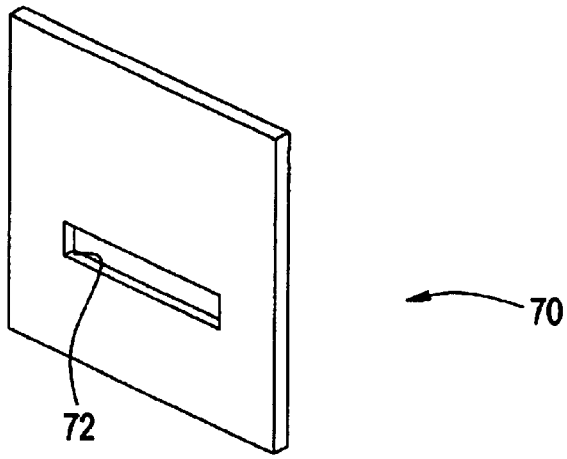
FIG. 4 is an enlarged perspective view of the gasket of FIG. 1.

Referring now to FIGS. 1, 2 and 4, a gasket 70 is configured with a slot 72 sized to receive a strap 57, 58 therethrough while the perimeter defining gasket 70 substantially corresponds to the dimensions of a wall 74 of cover 66 and a wall 77 of each lug compartment 62 having a strap 57, 58 extending therethrough. Gasket 70 is positioned against a corresponding wall 77 over a strap 57, 58 extending therethrough to provide insulation between circuit breaker base 18 and cover 66. The gasket 70 is preferably fabricated from a temperature resistive insulative material, such as a resilient elastomer like sheet silicone rubber. In an exemplary embodiment the silicon rubber may include a one sided acrylic adhesive thereon. Each cover 66 includes a strap slot 76 configured in wall 74 to receive a strap 57, 58 therethrough. Strap slot 76 is aligned with a corresponding strap aperture 78 configured in lug 54 when lug 54 is received in cover 66 to receive a strap 57, 58 therethrough. Cover 66 is positioned in a corresponding lug compartment 62 over a strap 57, 58 and retained therein by means of a press-fit connection with snap-fit features 64 and rails 60. The lug cover 66 can be fabricated from an insulative material, such as a resilient plastic. When a plastic lug cover 66 is employed, the lug cover not only provides added electrical insulation to the lugs but also serves to restrain the lugs from moving in the horizontal and vertical directions, as viewed in FIG. 1. When the lugs are positioned within a corresponding cover 66, the lugs 54 become entrapped under the confines provided by wall 74 and opposing L-shaped walls 80 extending from opposing ends of wall 74 such that the lugs cannot be readily removed from a cavity 82 defined by walls 69, 74, and 80.

As best seen in FIG. 3, bottom wall 69 is further defined with a cavity 84 configured therein to retain a threaded nut 86. Threaded nut 86 is configured to be rotationally restrained in cavity 84 while threadably receiving terminal screw 61 (see FIG. 5). Bottom wall 69 and cavity 84 are further defined by a cylinder 89 extending therefrom. Cylinder 89 is integrally formed with cover 66 and is configured to insulate terminal screw 61 extending through nut 86 and external cover 66. The cavity 84 provided within the bottom wall 69 preferably holds nut 86 between the perimeters defining each.

The circuit breaker 10 is shown in FIG. 1 with two lugs 54 attached to their respective line straps 58 and within their respective line lug compartments 62. The terminal screws 61 are readily accessible from the top of the breaker via apertures 88 to facilitate electrical connection between the lugs 54 and the external circuit. FIG. 1 illustrates three different terminal connections that may be made in the field using cover 66 and gasket 70 (of FIGS. 3 and 4) while FIG. 5 illustrates a fourth discussed further herein. First, with respect to FIG. 1, lug 54 is configured to receive a wire conductor 90 through an opening 92 for connection with strap 58. The terminal screw 61 is tightened to pinch wire 90 against strap 58 extending through strap aperture 78 configured in lug 54. Second, cover 66 may be employed to couple a bus bar 94 to strap 58 by aligning apertures 96 configured in strap 58 and bus bar 94 for receiving terminal screw 61 therethrough for threadably tightening with nut 86 disposed within cavity 84 of cover 66. Similarly, in a third terminal connection, a ring terminal 98 coupled to a wire conductor 100 (e.g., crimped) may be coupled to strap 58 by aligning apertures 96 configured in strap 58 and ring terminal 98 for receiving terminal screw 61 therethrough for threadably tightening with nut 86 disposed within cavity 84 of cover 66. It will be recognized by one skilled in the art that a U-shaped terminal may be utilized instead of a ring terminal and employed in the same manner described above. Although not shown in FIG. 1, the lugs or other terminal connections are attached to the load straps 56 in a similar manner and shown with respect to FIG. 5, for example.

Referring now to FIG. 5, a fourth terminal connection that may be employed in the field using cover 66 and gasket 70 (of FIGS. 3 and 4) is illustrated. A U-shaped clamp or saddle clamp 102, well known in the art, may be employed instead of lug 54 with cover 66 and gasket 70 for electrically connecting wire conductor 90 of FIG. 1 with a strap 57. In this manner, the saddle clamp is disposed in cavity 82 of cover 66 over nut 86 and for electrically connecting smaller wire conductors 90 to strap 57 by threadably tightening terminal screw 61 extending through saddle clamp 102 into nut 86. Examples of such saddle clamp structures that may be employed with cover 66 and gasket 70 are described in more detail in U.S. Pat. No. 3,824,555, entitled "Electrical Conductor Terminal Assembly", which is incorporated herein by reference in its entirety.

The above described cover and gasket assembly facilitates field-installation of the lugs to the circuit breaker case, as well as allowing different terminal connections using the same cover configuration. The cover and gasket also protect the lugs and lug or terminal screws from carbon deposits and pole to pole dielectric breakdown by offering better isolation for the lugs or terminal connectors.

While the invention has been described with reference to an exemplary embodiment, it will be understood by those skilled in the art that various changes may be made and equivalents may be substituted for elements thereof without departing from the scope of invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A circuit breaker comprising:

a molded case;

a strap terminal extending from said molded case;

a terminal connector attached to said strap terminal, said terminal connector disposed in said circuit breaker molded case; and an insulator discrete from said molded case disposed around said terminal connector, said insulator trapped into said circuit breaker molded case by disposing said terminal connector around said strap terminal and attachment of said terminal connector to said strap terminal, said insulator being configured to be used with a plurality of different field installable terminal connectors, said insulator being disposed around four discrete faces defining said terminal connector.

2. The molded case circuit breaker defined in claim 1 wherein said insulator comprises a substantially C-shaped member having a bottom wall disposed under said terminal connector, said C-shaped member defined by a back wall for disposal against said molded case, and sidewalls connected with said bottom wall and said back wall extending along opposite sides of said terminal connector, a snap-fit feature extending from at least one of each side wall and said bottom wall, each said snap-fit feature configured for snap-fit engagement with said molded case having a complementary snap-fit feature for snap-fit engagement therebetween.

3. The molded case circuit breaker defined in claim 2 wherein said insulator is configured to receivably retain a lug in a cavity defined by said C-shaped member.

4. The molded case circuit breaker defined in claim 2 wherein said bottom wall includes a cavity configured to retain a threaded nut therein, said strap terminal is electrically connected to said terminal connector via a terminal screw extending through said terminal connector and said strap terminal threadably engaged with said threaded nut.

5. The molded case circuit breaker defined in claim 4 wherein said bottom wall includes an aperture configured therein to allow said terminal screw to extend therethrough.

6. The molded case circuit breaker defined in claim 5 wherein said aperture is defined by a cylinder extending from said bottom wall, said cylinder insulating said terminal screw extending therethrough.

7. The molded case circuit breaker defined in claim 1 wherein said terminal connector is one of:

a lug;

a ring terminal;

a U terminal;

a saddle clamp; and a bus bar.

8. The molded case circuit breaker defined in claim 1 further comprising:

a gasket disposed over said strap terminal and intermediate said molded case and said insulator.

9. The molded case circuit breaker defined in claim 2 wherein said back wall includes a slot configured to receive said strap terminal therethrough.

10. The molded case circuit breaker defined in claim 2 wherein said sidewalls, said back wall and a side opposite said back wall confine said terminal connector, said confinement limiting movement of said insulator relative to said terminal connector.

11. The molded case circuit breaker defined in claim 2 wherein a side opposite said back wall is substantially open and configured to receive an external conductor therethrough.

12. The molded case circuit breaker defined in claim 11 wherein said external conductor includes one of:

a bus bar, a wire conductor;

a U-terminal; and a ring terminal.

13. The molded case circuit breaker defined in claim 3 wherein said lug is slidably inserted into said insulator toward said bottom wall until terminal connector abuts one of said bottom wall and said strap terminal prior to threadably securing said terminal connector to said strap terminal.

14. The molded case circuit breaker defined in claim 1 wherein said strap terminal is one of a line strap terminal and a load strap terminal.

15. The molded case circuit breaker defined in claim 1 having one or more poles.

16. A circuit breaker comprising in combination:

a molded plastic circuit breaker case;

means within said case interrupting circuit current upon occurrence of an overcurrent condition through an associated electric circuit;

line straps extending from line slots formed within a line end of said case adapted for connection with said electric circuit;

load straps extending from load slots formed within a load end of said case adapted for connection with a load;

terminal connectors disposed around and attached to said load and line straps, said terminal connectors disposed in said circuit breaker molded case, said terminal connectors adapted for connection with one of said electrical circuit and said load; and a cover arranged over said line or said load straps electrically-isolating said line or load straps, said cover discrete from said molded case disposed around four discrete faces defining said terminal connector, said cover trapped into said circuit breaker molded case by attachment of said terminal connector to a respective strap, said cover being configured to be used with a plurality of different field installable terminal connectors.

17. The circuit breaker of claim 16 further comprising:

a gasket disposed over each said respective strap and intermediate said molded case and said cover.

18. The circuit breaker of claim 17 wherein said cover comprises a substantially C-shaped member having a bottom wall disposed under said terminal connector, said C-shaped member defined by a back wall for disposal against said gasket, and sidewalls connected with said bottom wall and said back wall extending along opposite sides of said terminal connector, a snap-fit feature extending from at least one of each side wall and said bottom wall, each said snap-fit feature configured for snap-fit engagement with said molded case having a complementary snap-fit feature for snap-fit engagement therebetween.

19. The circuit breaker of claim 18 wherein said cover is configured to receivably retain a lug in a cavity defined by said C-shaped member.

20. The molded case circuit breaker of claim 19 wherein said bottom wall includes a cavity configured to retain a threaded nut therein, said strap terminal is electrically connected to said terminal connector via a terminal screw extending through said terminal connector and said strap terminal threadably engaged with said threaded nut.

21. The circuit breaker of claim 16 wherein said terminal connector is one of:

a lug;

a ring terminal;

a U terminal;

a saddle clamp; and a bus bar.

22. A molded insulator cover for a circuit breaker molded case comprising:

a terminal connector disposable around and attachable to the strap terminal, said terminal connector disposed in the circuit breaker molded case; and an insulator cover discrete from the molded case disposed around four discrete faces defining said terminal connector, said insulator cover trapped into said circuit breaker molded case by attachment of said terminal connector to said strap terminal, said insulator cover being configured to be used with a plurality of different field installable terminal connectors.

23. The molded insulator cover of claim 22 further comprising:

a gasket disposed over each said respective strap and intermediate said molded case and said cover.

24. The molded insulator cover of claim 23 wherein said cover comprises a substantially C-shaped member having a bottom wall disposed under said terminal connector, said C-shaped member defined by a back wall for disposal against said gasket, and sidewalls connected with said bottom wall and said back wall extending along opposite sides of said terminal connector, a snap-fit feature extending from at least one of each side wall and said bottom wall, each said snap-fit feature configured for snap-fit engagement with said molded case having a complementary snap-fit feature for snap-fit engagement therebetween.

25. The molded insulator cover of claim 24 wherein said cover is configured to receivably retain a lug in a cavity defined by said C-shaped member.

26. The molded insulator cover of claim 25 wherein said bottom wall includes a cavity configured to retain a threaded nut therein, said strap terminal is electrically connected to said terminal connector via a terminal screw extending through said terminal connector and said strap terminal threadably engaged with said threaded nut.

* * * * *